US006464492B1

(12) United States Patent
Guarco et al.

(10) Patent No.: US 6,464,492 B1
(45) Date of Patent: Oct. 15, 2002

(54) METHODS OF UTILIZING BOILER BLOWDOWN FOR REDUCING $NO_X$

(75) Inventors: John P. Guarco, Wolcott, CT (US); Andrew S. Barrieau, Guilford, CT (US); Lev M. Tsirulnikov, Brooklyn, NY (US)

(73) Assignee: John Zink Company, LLC, Tulsa, OK (US)

( * ) Notice: Subject to any disclaimer, the term of this patent is extended or adjusted under 35 U.S.C. 154(b) by 0 days.

(21) Appl. No.: 09/843,418

(22) Filed: Apr. 26, 2001

(51) Int. Cl.[7] ..... F23J 15/02

(52) U.S. Cl. ..... 432/91; 122/451 R; 122/448.1; 110/345

(58) Field of Search ..... 432/91; 122/23, 122/382, 396, 451 R, 403, 448.1, 367.1; 423/235; 110/245, 345

(56) References Cited

U.S. PATENT DOCUMENTS

| | | | | |
|---|---|---|---|---|
| 4,659,305 A | * | 4/1987 | Nelson et al. | 431/9 |
| 5,120,517 A | * | 6/1992 | Elshout | 423/239 |
| 5,915,310 A | * | 6/1999 | Hura et al. | 110/345 |
| 6,210,150 B1 | * | 4/2001 | Rosen et al. | 431/11 |

* cited by examiner

*Primary Examiner*—Gregory Wilson
(74) *Attorney, Agent, or Firm*—C. Clark Dougherty, Jr.; McAfee & Taft

(57) ABSTRACT

The present invention provides improved methods of reducing $NO_x$ emissions in the flue gases produced by a steam boiler fired by a fluid fuel and combustion air burner and including a steam drum provided with make-up water from which produced steam and blowdown steam are withdrawn. In accordance with the invention at least a portion of the blowdown steam is combined with the fluid fuel or combustion air or both.

26 Claims, 2 Drawing Sheets

METHODS OF UTILIZING BOILER BLOWDOWN FOR REDUCING $NO_X$

BACKGROUND OF THE INVENTION

1. Field of the Invention

This invention relates to improved methods of reducing $NO_x$ emissions produced by a steam boiler fired by a fluid fuel and combustion air burner.

2. Description of the Prior Art

Packaged unit and other steam boilers which are fired by fluid fuel and combustion air burners are commonly used in chemical and other process installations. Such boilers include a steam drum which is provided with feed water and from which produced steam is withdrawn. In order to maintain the appropriate total dissolved solids in the boiler water and avoid scale formation, blowdown steam is withdrawn from the steam drum. The blowdown steam flow depends on the feed water quality and typically amounts to in the range of from about 1.5 to about 5% of the total steam produced by the boiler. The blowdown steam is released to the atmosphere or used to preheat the feed water and then released to the atmosphere.

In order to reduce the $NO_x$ emissions produced by the steam boilers, a portion of the produced process steam has heretofore been combined with the combustion air utilized by the steam boiler burner. This usage of process steam lowers the efficiency of the boiler or requires additional make-up water which increases the cost of operating the boiler.

Thus, there are needs for more efficient methods of reducing $NO_x$ emissions produced by steam boilers.

SUMMARY OF THE INVENTION

The present invention provides methods of reducing $NO_x$ emissions in the flue gases produced by a steam boiler fired by a fluid fuel and combustion air burner which meets the needs described above and overcomes the deficiencies of the prior art. The methods of the present invention basically comprise combining at least a portion of the blowdown steam which would otherwise be wasted with the fluid fuel utilized by the boiler. In addition, the blowdown steam can be combined with the combustion air and injected into the furnace of the boiler to reduce $NO_x$ and stabilize the flame in the furnace.

An improved method of the present invention for reducing the $NO_x$ emissions produced by a steam boiler fired by a fluid fuel and combustion air burner includes the steps of combining a portion of the flue gases produced by the boiler with the combustion air and combining a portion of the blowdown steam from the boiler with the fluid fuel.

Yet another improved method of reducing $NO_x$ emissions produced by a steam boiler fired by a fluid fuel and combustion air burner includes the steps of combining a portion of the flue gases produced by the boiler and a portion of the blowdown steam from the boiler with the combustion air and combining another portion of the flue gases and another portion of the blowdown steam with the fluid fuel Still another improved method of the present invention for reducing. the $NO_x$ emissions produced by a steam boiler fired by a fluid fuel and combustion air burner includes the steps of withdrawing a minor portion of blowdown steam and a major portion of blowdown water containing a high level of dissolved solids from the boiler, purifying the blowdown water and recirculating it as a part of the make-up water to the boiler, combining a portion of the flue gases produced by the boiler with the combustion air and combining at least a portion of the blowdown steam from the boiler with the fluid fuel.

Thus, it is a principle object of the present invention to provide improved methods of reducing $NO_x$ emissions produced by a steam boiler fired by a fluid fuel and combustion air burner.

Other and further objects, features and advantages of the present invention will be readily apparent to those skilled in the art upon a reading of the description of preferred embodiments which follows when taken in conjunction with the accompanying drawings.

DESCRIPTION OF PREFERRED EMBODIMENTS

As mentioned above, steam boilers fired by fluid fuel and combustion air burners have included steam drums from which produced steam and blowdown steam are withdrawn. The blowdown steam withdrawn from the steam drum is required to maintain an appropriate dissolved solids content in the boiler water whereby adverse scale formation does not result. The blowdown steam is either vented to the atmosphere or used for preheating the boiler make-up water with the remaining steam being vented to the atmosphere. Typically, the substantially wasted blowdown steam comprises from about 1.5 to about 5% of the total steam produced by the steam boiler.

In accordance with the present invention, the heretofore wasted blowdown steam is at least partially utilized for reducing the $NO_x$ emissions produced by the boiler. That is, the blowdown steam is combined with the boiler fluid fuel and/or the combustion air and/or injected into the flame produced by the burner and/or injected into the furnace space. In addition, as is known in the art, a portion of the flue gases generated by the boiler can be recycled and injected into the combustion air and/or fuel gas. The particular amounts of the blowdown steam and recycled flue gases as well as the particular points in the boiler system where the blowdown steam and flue gases are injected are determined by trial and error procedures to arrive at the lowest flue gas $NO_x$ emissions possible.

Figure 1:
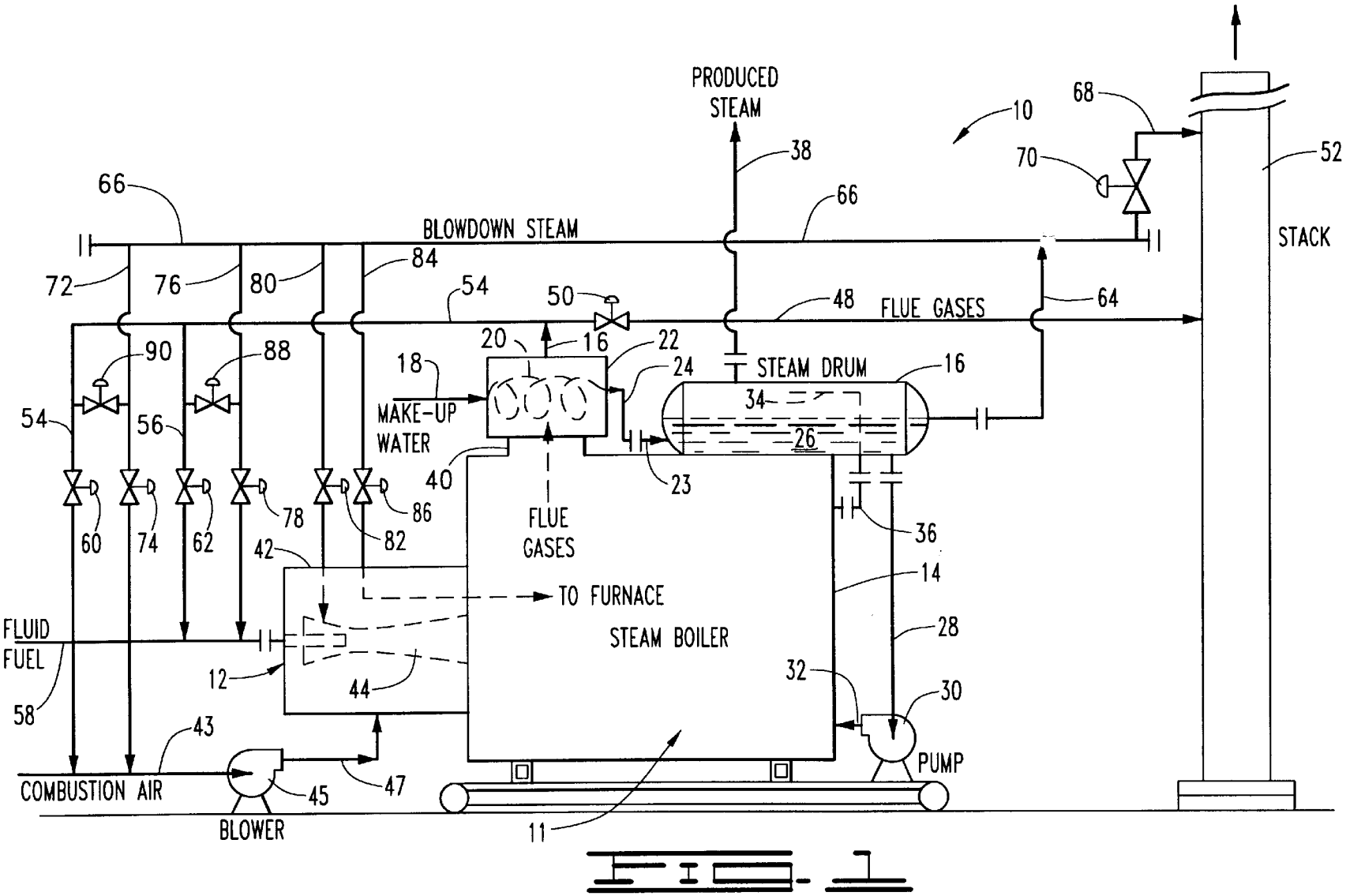
FIG. 1 is a schematic illustration of a packaged unit steam boiler which includes blowdown steam and flue gases injection in accordance with the present invention.

Referring now to FIG. 1, a steam boiler system for carrying out the methods of the present invention is illustrated and generally designated by the numeral 10. The boiler system 10 includes a steam boiler 11 which includes a fluid fuel and combustion air burner 12 and an enclosed furnace 14 in which the fluid fuel and combustion air are combusted. A tube bank (not shown) is disposed within the furnace 14 into which water is pumped. As the water flows through the tube bank, it is heated by the products of combustion in the furnace and converted to steam as is well known and understood by those skilled in the art. A steam drum 16 is provided as a part of the steam boiler 11. Make-up water is conducted to the boiler 11 by a conduit 18 which is connected to a heating coil 20 disposed within a heat exchanger or economizer 22 through which hot flue gases generated within the furnace 14 flow as will be described further hereinbelow. The make-up water is preheated as it flows through the heat exchange coil 20 in the economizer 22 and is conducted from the economizer 22 to a water inlet connection 23 of the steam drum 16 by way of a conduit 24. A level of water 26 is maintained in the steam drum 16 and water from the steam drum 16 flows by way of a conduit 28 to a pump 30. The pump 30 pumps the water into the tube bank (not shown) within the furnace 14 by way of a conduit 32 connected between the pump 30 and the tube bank. While flowing through the tube bank, the water is converted to steam and the produced steam from the tube bank is conducted to a steam lance 34 within the steam drum 16 by a conduit 36. The produced steam is discharged from the lance 34 within the steam drum 16 above the level of the water 26 and is withdrawn therefrom by a conduit 38 connected to the steam drum 16. The conduit 38 conducts the produced steam to one or more locations where the steam is utilized.

A fluid fuel and combustion air burner 12 is connected to the furnace 11. As is well understood by those skilled in the art, the fluid fuel and combustion air burner produces hot products of combustion which circulate through and around the tube bank within the furnace 14 thereby generating steam. The hot products of combustion are withdrawn from the furnace 14 as flue gases by way of a flue gases outlet pipe 40 connected to the economizer 22.

The term "fluid fuel" is used herein to mean a gaseous fuel or a liquid fuel which is atomized within the burner 12. The gaseous fuel can be comprised of one or a mixture of light hydrocarbons such as methane, ethane or natural gas. The liquid fuel is generally a standardized fuel oil comprised of a mixture of liquid hydrocarbons.

The burner 12 can take a variety of forms well known to those skilled in the art. Generally, the burner 12 includes a combustion air box 42 and a fluid fuel primary nozzle assembly 44. The fluid fuel and combustion air are discharged by the primary nozzle 44 into a primary combustion zone (not shown) in the furnace 14. One or more secondary nozzles which introduce fluid fuel only or fluid fuel and combustion air into one or more secondary combustion zones (not shown) are often also utilized. In whatever form the burner 12 takes, the fluid fuel and combustion air are combusted within the furnace 14 thereby forming hot products of combustion which flow through and around the tube bank within the furnace 14.

Fluid fuel from a source thereof (not shown) is conducted to the nozzle assembly 44 and other nozzles (if any) of the burner 12 by a conduit 58. Combustion air is provided to the combustion air box 42 of the burner 12 by a combustion air blower 45. The outlet of the combustion air blower 45 is connected to the combustion air box 42 by a conduit 47 and inlet combustion air is conducted to the combustion air blower 45 by a conduit 43.

The products of combustion from the burner 12 contain various components including nitrogen oxides which are referred to herein as "$NO_x$." A number of techniques have heretofore been developed for reducing the quantity of the $NO_x$ emissions in the flue gases formed by burning fluid fuel and combustion air. Such techniques include combining recirculated flue gases with the burner fluid fuel, combustion air or both. In addition, the techniques include combining produced steam with the fluid fuel and combustion air as well as introducing produced steam into the flame and flue gases in the furnace in order to stabilize the flame and reduce $NO_x$ emissions. As mentioned, the present invention utilizes the heretofore wasted blowdown steam from the boiler 11 thereby avoiding lowering the produced steam capacity of the boiler system and/or increasing the boiler operating expense.

Referring again to FIG. 1, the flue gases generated within the furnace 14 of the boiler system 10 flow through the economizer 22 and exit the economizer by way of a conduit 46 connected thereto. The conduit 46 is connected to a conduit 48 having a control valve 50 disposed therein. The other end of the conduit 48 is connected to a stack 52 from which the flue gases flowing into the stack 52 by way of the conduit 48 are vented to the atmosphere. A second conduit 54 is also connected to the conduit 46 which conducts a portion of the flue gases generated in the furnace 12 to the combustion air inlet conduit 43 connected to the combustion air blower 45. A second conduit 56 connected to the conduit 54 conducts another portion of the flue gases to the fluid fuel inlet conduit 58 which is connected to the burner 12. A control valve 60 is disposed in the conduit 54 and a control valve 62 is disposed in the conduit 56 for controlling the amounts of the flue gases mixed with the fluid fuel and combustion air flowing to the burner 12. The control valve 50 in the conduit 48 divides the flow of flue gases from the conduit 46 between the stack 52 and the fluid fuel to the burner 12 and air to the combustion air blower 45.

Blowdown steam is withdrawn from the steam drum 16 by a conduit 64 which conducts the blowdown steam to a header 66. A conduit 68 having a control valve 70 disposed therein is connected between the header 66 and the stack 52. A conduit 72 having a control valve 74 disposed therein is connected between the header 66 and the combustion air inlet conduit 43 connected to the air blower 45. A conduit 76 having a control valve 78 disposed therein is connected between the header 66 and the fluid fuel inlet conduit 58 connected to the burner 12. A conduit 80 having a control valve 82 disposed therein is connected to the header 66 and to the nozzle assembly 44 within the air box 42. A conduit 84 having a control valve 86 disposed therein is connected between the header 66 and the furnace 14. As will be understood, the control valves 74, 78, 82 and 86 distribute the blowdown steam from the header 66 into the burner combustion air, into the burner fluid fuel, into the flame produced by the primary nozzle assembly 44 and into the boiler furnace 14. If it is desired to control the ratio of blowdown steam to the recirculated flue gases prior to introducing the mixtures into the fluid fuel and air, the control valves 88 and 90 can be utilized for that purpose. The control valve 70 in the conduit 68 divides the flow of blowdown steam from the conduit 64 between the stack 52 and the air to the blower 45, the fuel to the burner 12, the air and fuel mixture in the nozzle assembly 44 and the flue gases circulating in the furnace 14.

As mentioned above, the presence of the blowdown steam in the combustion air and fluid fuel with or without the presence of flue gases therein and in the furnace 14 functions to reduce $NO_x$ emissions into the flue gases. The quantities of the blowdown steam included in one or more of the fluid fuel, the combustion air and the furnace 14 with or without flue gases therein is determined by trial and error to maximize the reduction of $NO_x$ emissions.

The substitution of blowdown steam for produced steam to reduce $NO_x$ emissions in accordance with this invention improves the boiler net thermal efficiency by approximately 20%.

Figure 2:
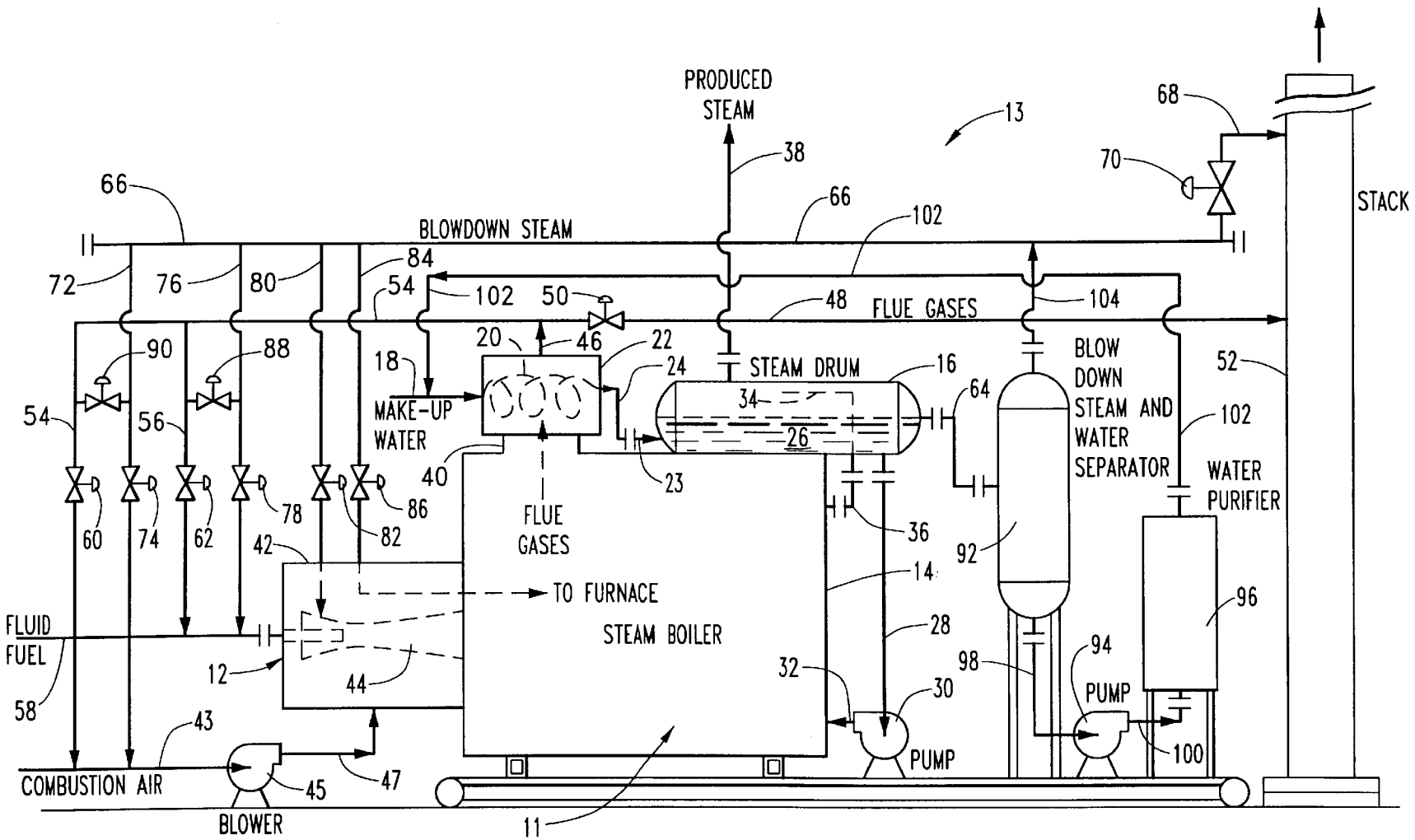
FIG. 2 is a schematic illustration of the steam boiler of FIG. 1 which further includes a blowdown steam and water separator, a water pump and a water purifier.

Referring now to FIG. 2, a steam boiler system 13 is illustrated which is identical to the system 10 shown in FIG. 1 and described above and uses the same reference numerals as in FIG. 1. The only difference between the system 10 and the system 13 shown in FIG. 2 is that a blowdown steam and water separator 92, a separated water pump 94, a water purifier 96 and conduits 98, 100, 102 and 104 have been added to the system 13.

In the system 13, a blowdown stream containing a minor portion of blowdown steam and a major portion of water containing a high level of dissolved solids are withdrawn from the steam drum and conducted by the conduit 64 to the separator 92. The blowdown stream of steam and water is withdrawn from the steam drum 16 at a point whereby the blowdown stream contains from about 5% to about 10% blowdown steam and from about 90% to about 95% water by volume of said blowdown stream. The blowdown steam and withdrawn water are separated in the separator 92 with the separated blowdown steam being conducted to the blowdown steam header 66. The separated withdrawn water containing dissolved solids is pumped from the separator 92 by way of the conduit 98 and the pump 94 and conducted by the conduct 100 to the water purifier 96. From the water purifier 96, purified water, i.e., water having a major portion of dissolved solids removed therefrom, is conducted to the steam boiler 11 make-up water conduit 18 by the conduit 102 whereby it is recirculated through the steam boiler 11.

The use of the separator 92 and water purifier 96 in the system 13 allows the $NO_x$ emissions from the boiler 11 to be reduced without sacrificing any significant boiler net thermal efficiency.

An improved method of the present invention for reducing $NO_x$ emissions in the flue gases produced by a steam boiler fired by a fluid fuel and combustion air burner and including a steam drum provided with make-up water and from which produced steam and blowdown steam are withdrawn, the blowdown steam being withdrawn to maintain appropriate total dissolved solids in the boiler water, basically comprises the step of combining at least a portion of the blowdown steam with the fluid fuel.

Another improved method of this invention for reducing the $NO_x$ emissions in the flue gases produced by a steam boiler fired by a fluid fuel and combustion air burner and including a steam drum provided with make-up water and from which produced steam and blowdown steam are withdrawn, the blowdown steam being withdrawn to maintain appropriate total dissolved solids in the boiler water, comprises the steps of combining a portion of the flue gases with the combustion air and combining a portion of the blowdown steam with the fluid fuel.

Yet another improved method of reducing the $NO_x$ emissions in the flue gases produced by a steam boiler fired by a fluid fuel and combustion air burner and including a steam drum provided with make-up water and from which produced steam and blowdown steam are withdrawn, the blowdown steam being withdrawn to maintain appropriate total dissolved solids in the boiler water, comprises the steps of combining a portion of the flue gases with the combustion air, combining a portion of the blowdown steam with the combustion air, combining a portion of the flue gases with the fluid fuel and combining a portion of the blowdown steam with the fluid fuel.

Still another improved method of the present invention for reducing $NO_x$ emissions in the flue gases produced by a steam boiler fired by a fluid fuel and combustion air burner and including a steam drum containing water having a high level of dissolved solids therein and provided with make-up water from which produced steam and blowdown steam are withdrawn, the blowdown steam being withdrawn to maintain appropriate total dissolved solids in the boiler water, comprises the steps of withdrawing a minor portion of blowdown steam and a major portion of water containing a high level of dissolved solids from the steam drum, purifying the withdrawn water and recirculating the purified water as a part of the make-up water to the steam drum, combining a portion of the flue gases produced by the boiler with the combustion air and combining at least a portion of the blowdown steam withdrawn from the steam drum with the fluid fuel.

Thus, the present invention is well adapted to carry out the objects and attain the ends and advantages mentioned as well as those which are inherent therein. While numerous changes may be made by those skilled in the art, such changes are encompassed within the spirit of this invention as defined by the appended claims.

What is claimed is:

1. In a method of reducing the $NO_x$ emissions in the flue gases produced by a steam boiler fired by a fluid fuel and combustion air burner and including a steam drum provided with make-up water and from which produced steam and blowdown steam are withdrawn, the blowdown steam being withdrawn to maintain appropriate total dissolved solids in the boiler water, the improvement which comprises combining at least a portion of said blowdown steam with said fluid fuel.

2. The method of claim 1 which further comprises the step of combining at least a portion of said blowdown steam with said combustion air.

3. The method of claim 1 which further comprises the step of combining a portion of said flue gases with said combustion air.

4. The method of claim 1 wherein said fluid fuel is a gaseous hydrocarbon or a mixture of gaseous hydrocarbons.

5. The method of claim 1 wherein said fluid fuel is natural gas.

6. The method of claim 1 wherein said fluid fuel is a liquid which is atomized in said burner.

7. The method of claim 1 wherein said fluid fuel is a liquid hydrocarbon or a mixture of liquid hydrocarbons.

8. A method of reducing the $NO_x$ emissions in the flue gases produced by a steam boiler fired by a fluid fuel and combustion air burner and including a steam drum provided with make-up water and from which produced steam and blowdown steam are withdrawn, the blowdown steam being withdrawn to maintain appropriate total dissolved solids in the boiler water, comprising the steps of:

(a) combining a portion of said flue gases with said combustion air; and (b) combining a portion of said blowdown steam with said fluid fuel.

9. The method of claim 8 which further comprises the step of combining a portion of said blowdown steam with said combustion air.

10. The method of claim 8 wherein said fluid fuel is a gaseous hydrocarbon or mixture of gaseous hydrocarbons.

11. The method of claim 8 wherein said fluid fuel is natural gas.

12. The method of claim 8 wherein said fluid fuel is a liquid fuel which is atomized in said burner.

13. The method of claim 8 wherein said fluid fuel is a liquid hydrocarbon or a mixture of liquid hydrocarbons.

14. A method of reducing $NO_x$ emissions in the flue gases produced by a steam boiler fired by a fluid fuel and combustion air burner and including a steam drum provided with make-up water and from which produced steam and blowdown steam are withdrawn, the blowdown steam being withdrawn to maintain appropriate total dissolved solids in the boiler water, comprising the steps of:

(a) combining a portion of said flue gases with said combustion air;

(b) combining a portion of said blowdown steam with said combustion air;

(c) combining a portion of said flue gases with said fluid fuel; and (d) combining a portion of said blowdown steam with said fluid fuel.

15. The method of claim 14 wherein said fluid fuel is a gaseous hydrocarbon or mixture of gaseous hydrocarbons.

16. The method of claim 14 wherein said fluid fuel is natural gas.

17. The method of claim 14 wherein said fluid fuel is a liquid hydrocarbon or a mixture of liquid hydrocarbons.

18. A method of reducing $NO_x$ emissions in the flue gases produced by a steam boiler fired by a fluid fuel and combustion air burner and including a steam drum provided with make-up water and from which produced steam and blowdown steam are withdrawn, the blowdown steam being withdrawn to maintain appropriate total dissolved solids in the boiler water, comprising the steps of:

(a) withdrawing a blowdown stream of steam and water from said steam drum containing a minor portion of said blowdown steam and a major portion of said water having a high level of dissolved solids therein;

(b) purifying said water withdrawn from said steam drum in accordance with step (a) and recirculating the purified water as a part of said make-up water to said steam drum; (c) combining a portion of said flue gases produced by said boiler with said combustion air; and (d) combining at least a portion of said blowdown steam withdrawn in accordance with step (a) from said steam drum with said fluid fuel.

19. The method of claim 18 which further comprises the step of combining a portion of said blowdown steam withdrawn in accordance with step (a) from said steam drum with said combustion air.

20. The method of claim 19 which further comprises combining a portion of said flue gases produced by said boiler with said fluid fuel.

21. The method of claim 18 wherein said fluid fuel is a gaseous hydrocarbon or a mixture of gaseous hydrocarbons.

22. The method of claim 18 wherein said fluid fuel is natural gas.

23. The method of claim 18 wherein said fluid fuel is a liquid fuel which is atomized in said burner.

24. The method of claim 18 wherein said fluid fuel is a liquid hydrocarbon or a mixture of liquid hydrocarbons.

25. The method of claim 18 wherein said minor portion of said blowdown steam in said blowdown stream withdrawn from said steam drum in accordance with step (a) is an amount of steam in the range of from about 5% to about 10% by volume of said blowdown stream.

26. The method of claim 18 wherein said major portion of said water having a high level of dissolved solids therein in said blowdown stream withdrawn from said steam drum in accordance with step (a) is an amount of water in the range of about 90% to about 95% by volume of said blowdown stream.

* * * * *